United States Patent [19]

Nakagawa et al.

[11] Patent Number: 5,009,210

[45] Date of Patent: Apr. 23, 1991

[54] AIR/FUEL RATIO FEEDBACK CONTROL SYSTEM FOR LEAN COMBUSTION ENGINE

[75] Inventors: Toyoaki Nakagawa; Hiroshi Sanbuichi, both of Yokohama; Katsunori Terasaka, Yokosuka; Makoto Saito, Yokohama, all of Japan

[73] Assignee: Nissan Motor Co., Ltd., Japan

[21] Appl. No.: 1,328

[22] Filed: Jan. 7, 1987

[30] Foreign Application Priority Data

Jan. 10, 1986 [JP] Japan ..... 61-3199

[51] Int. Cl.[5] ..... F02D 41/14; F02D 41/10

[52] U.S. Cl. ..... 123/489; 123/492

[58] Field of Search ..... 123/440, 489, 492, 493

[56] References Cited

U.S. PATENT DOCUMENTS

| | | | |
|---|---|---|---|
| 4,075,982 | 2/1978 | Asano et al. | 123/489 X |
| 4,131,091 | 12/1978 | Asano et al. | 123/489 X |
| 4,158,347 | 6/1979 | Aoki | 123/489 |
| 4,383,512 | 5/1983 | Ishikawa et al. | 123/440 |
| 4,408,588 | 10/1983 | Mausner | 123/489 |
| 4,434,768 | 3/1984 | Ninomiya | 123/489 |
| 4,561,403 | 12/1985 | Oyama et al. . | |
| 4,682,577 | 7/1987 | Kato et al. | 123/492 |
| 4,760,822 | 8/1988 | Mieno et al. | 123/589 X |

FOREIGN PATENT DOCUMENTS

| | | | |
|---|---|---|---|
| 215951 | 12/1984 | Japan | 123/489 |

OTHER PUBLICATIONS

"Nainen Kikan", vol. 23, No. 14 (1984), pp. 33–40.

*Primary Examiner*—Tony M. Argenbright
*Attorney, Agent, or Firm*—Lowe, PRice, LeBlanc, Becker & Shur

[57] ABSTRACT

The invention relates to a control systems for feedback control of the air/fuel ratio in an internal combustion engine, e.g., an automotive engine, which uses a three-way catalyst to purify the exhaust gas, by using an exhaust sensor to detect actual values of air/fuel ratio in the engine. The control system has the function of varying the target value of air/fuel ratio according to operating conditions of the engine. The target value becomes super-stoichiometric during steady-state operation of the engine and changes to a lower value optimum for the activities of the three-way catalyst, such as the stoichiometric value, under predetermined transient conditions of the engine. At the start of such a change in the target value, the control system functions so as to intentionally deviate the air/fuel ratio from the value optimum for the three-way catalyst in a direction away from the target value immediately before the change. By doing so NOx is effectively removed by the three-way catalyst with little delay from the change in the target value of air/fuel ratio accompanying the shift to a transient operating condition.

9 Claims, 6 Drawing Sheets

AIR/FUEL RATIO FEEDBACK CONTROL SYSTEM FOR LEAN COMBUSTION ENGINE

BACKGROUND OF THE INVENTION

This invention relates to a system for feedback control of the air/fuel ratio in an internal combustion engine, usually an automotive engine, which is to be normally operated with a lean mixture. The control system includes means to vary the target value of the air/fuel ratio at least under predetermined transient operating conditions of the engine.

Recent automotive engines have to satisfy severe requirements as to high power performance, low exhaust emission and good fuel economy all together. One approach to the solution of problems relating to such conflicting requirements is operating the engine with a very lean air-fuel mixture under precise control of the fuel feed system.

For example, a lean combustion automotive engine system is described in "NAINEN KIKAN" (a Japanese journal), Vol 23, No. 12 (1984), 33–40. This system includes an air/fuel ratio feedback control system, which uses an oxygen-sensitive solid electrolyte device as an exhaust sensor to detect the actual air/fuel ratio in the engine, and a three-way catalyst which catalyzes not only oxidation of CO and HC but also reduction of $NO_x$. The output of the exhaust sensor used in this system becomes nearly proportional to the actual air/fuel ratio over a wide range which extends from a slightly sub-stoichiometric ratio to an extremely super-stoichiometric ratio, so that feedback control of the air/fuel ratio can be performed with a widely variable target value. As a typical example, the target value of air/fuel ratio in the feedback control system is 21.5 during steadystate operation of the engine and changes to 22.5 under gently accelerating conditions, to 15.5 under idling conditions and to a sub-stoichiometric value in the range of about 12–13 under full-load operating conditions.

The use of a very lean mixture is very effective in reducing the emission of $NO_x$ to a level that meets the current regulations, though the three-way catalyst becomes less effective in reducing $NO_x$ when the engine is operated with either a very lean mixture or a very rich mixture. However, under steeply transient operating conditions of the engine it is impossible to realize the required power performance of the engine while maintaining a super-stoichiometric air/fuel ratio sufficient for reducing the emission of $NO_x$. To continue the lean combustion even under steeply transient conditions without dissatisfaction in any aspect, it is necessary to further improve the precision and quickness of the feedback control of air/fuel ratio from the state of the art. Therefore, it is customary to shift the air/fuel ratio under steeply transient operating conditions of the engine from a super-stoichiometric value to a sub-stoichiometric value to thereby maintain the required power performance and driveability even though this measure causes the emission of NOx to increase beyond tolerance.

SUMMARY OF THE INVENTION

It is an object of the present invention to provide an improved system for feedback control of the air/fuel ratio in an internal combustion engine using a three-way catalyst, which may be an automotive engine and is operated with a lean air-fuel mixture at least during predetermined steady-state operation, which control system has the function of changing the target value of the air/fuel ratio under predetermined transient operating conditions so as to maintain the required driveability while maintaining a satisfactorily low level of NOx emission.

To accomplish the above object the present invention proposes to shift the target value of the air/fuel ratio, under predetermined transient operating conditions of the engine, to a value optimum for the activities of the three-way catalyst on condition that at the start of shifting the feed of fuel, or air, is controlled such that the air/fuel ratio deviates from said value in a direction away from the target value before shifting, for a predetermined period of time.

More definitely, the invention provides a control system for feedback control of the air/fuel ratio of an air-fuel mixture supplied to an internal combustion engine which uses a three-way catalyst for purifying the exhaust gas, the control system comprising air/fuel ratio detection means for detecting actual values of air/fuel ratio in the engine, load detection means for detecting the load under which the engine is operating, transient condition detection means for detecting any of predetermined transient operating conditions of the engine, and control means for performing feedback control of the feed of fuel or air to the engine based on the detected actual values of air/fuel ratio. This control means comprises target value setting means for determining the target value of the air/fuel ratio according to information obtained by the load detection means and the transient condition detection means such that the target value becomes a first value which is higher than the stoichiometric air/fuel ratio at least during predetermined steady-state operation of the engine and shifts to a second value which is optimum for the activities of the three-way catalyst when any of the predetermined transient operating conditions is detected and modulation means for regulating the feed of fuel or air to the engine at the start of shifting the target value such that the air/fuel ratio deviates from the second value in the direction away from the target value that existed immediately before the shift only for a predetermined period of time.

The air/fuel ratio control system according to the invention is very suitable for application to automotive engines. In this feedback control system the target value of air/fuel ratio is temporarily shifted, usually from a super-stoichiometric value, to a value which is optimum for the activities of the three-way catalyst and which is usually the stoichiometric ratio (excess air factor $\lambda=1$) when the operating condition of the engine shifts to any of predetermined transient conditions such as steeply accelerating conditions. By this measure the driveability and power performance required under the transient condition can be maintained, while NOx increased in the exhaust gas is removed by the activity of the three-way catalyst. However, if the target value of air/fuel ratio is directly shifted to, for example, the stoichiometric ratio the removal of NOx by the three-way catalyst might be insufficient for a certain period of time because of a delay in the propagation of the effect of the stoichiometric ratio to the three-way catalyst disposed in the exhaust passage. In the present invention, this problem is solved by intentionally deviating the air/fuel ratio, at the start of shifting to the stoichiometric ratio, in a direction away from the original air/fuel ratio for a predetermined period of time compensatory of the aforementioned delay.

DESCRIPTION OF THE PREFERRED EMBODIMENTS

Figure 1:
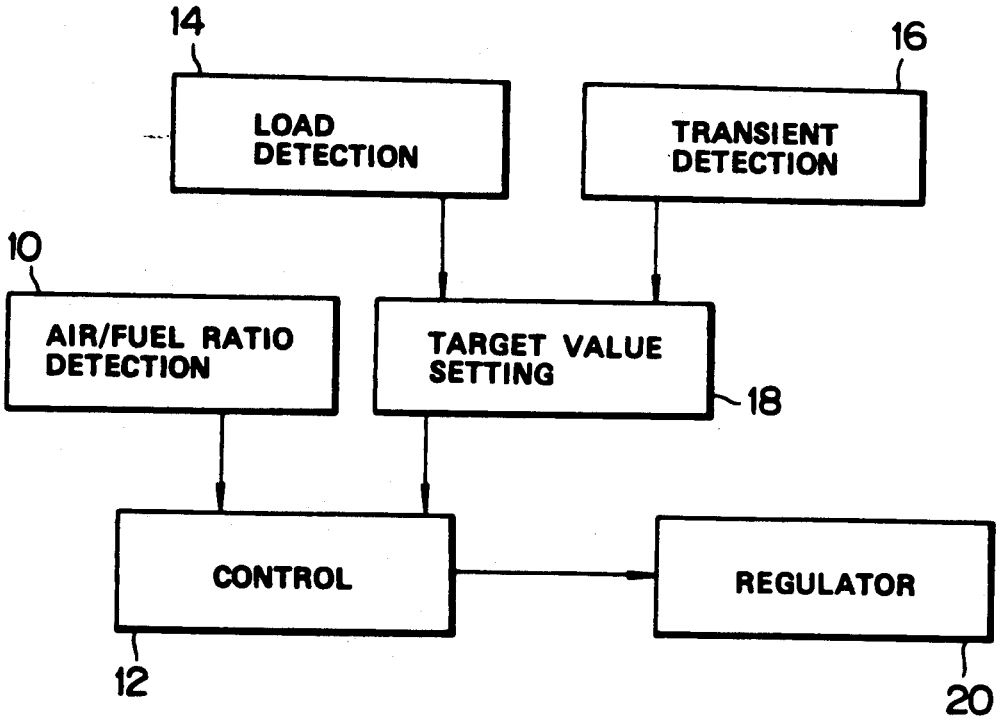
FIG. 1 is a block diagram showing the fundamental construction of an air/fuel ratio control system according to the invention.

FIG. 1 shows the functional connections between the principal elements of an air/fuel ratio control system according to the invention. This control system is applied to an internal combustion engine which is provided with a conventional three-way catalyst in the exhaust passage. The control system includes an air/fuel ratio detection means 10 to detect the actual air/fuel ratio in the engine by sensing, for example, the concentration of oxygen in the exhaust gas. An electronic control means 12 utilizes the air/fuel ratio signal produced by the detection means 10 to find any deviation of the actual air/fuel ratio from a target value and produces a fuel feed control signal, which is supplied to an electro-mechanical means 20 for minutely regulating the ratio of air to fuel being taken into the engine. Furthermore, the air/fuel ratio control system includes a load detection means 14 to detect the load under which the engine is operating, a transient condition detection means 16 to detect predetermined transient operating conditions of the engine and a target value setting means 18 which receives information signals from both the load detection means 14 and the transient condition detection means 16 and sets the target value of the air/fuel ratio normally at a first value higher than the stoichiometric ratio and, when the signals from the two detection means 14 and 16 continue to indicate that the engine is operating under a predetermined transient condition, at a second value which is lower than the first value and is optimum for the activities of the three-way catalyst. The target value is always input to the control means 12.

As an important feature of the target value setting means 18 in the present invention, the first target value of the air/fuel ratio is not directly shifted to the second target value. When the input signals indicate establishment of a predetermined transient operating condition, the target value of the air/fuel ratio is immediately shifted to a third value which is still lower than the aforementioned second value, and the target value is kept lower than the second value for a predetermined period of time. Alternatively, the regulation means 20 is afforded with the function of maintaining the actual air/fuel ratio lower than the second target value for the predetermined period of time in response to the command from the target value setting means 18 to shift the target value from the first value to the second value.

Figure 2:
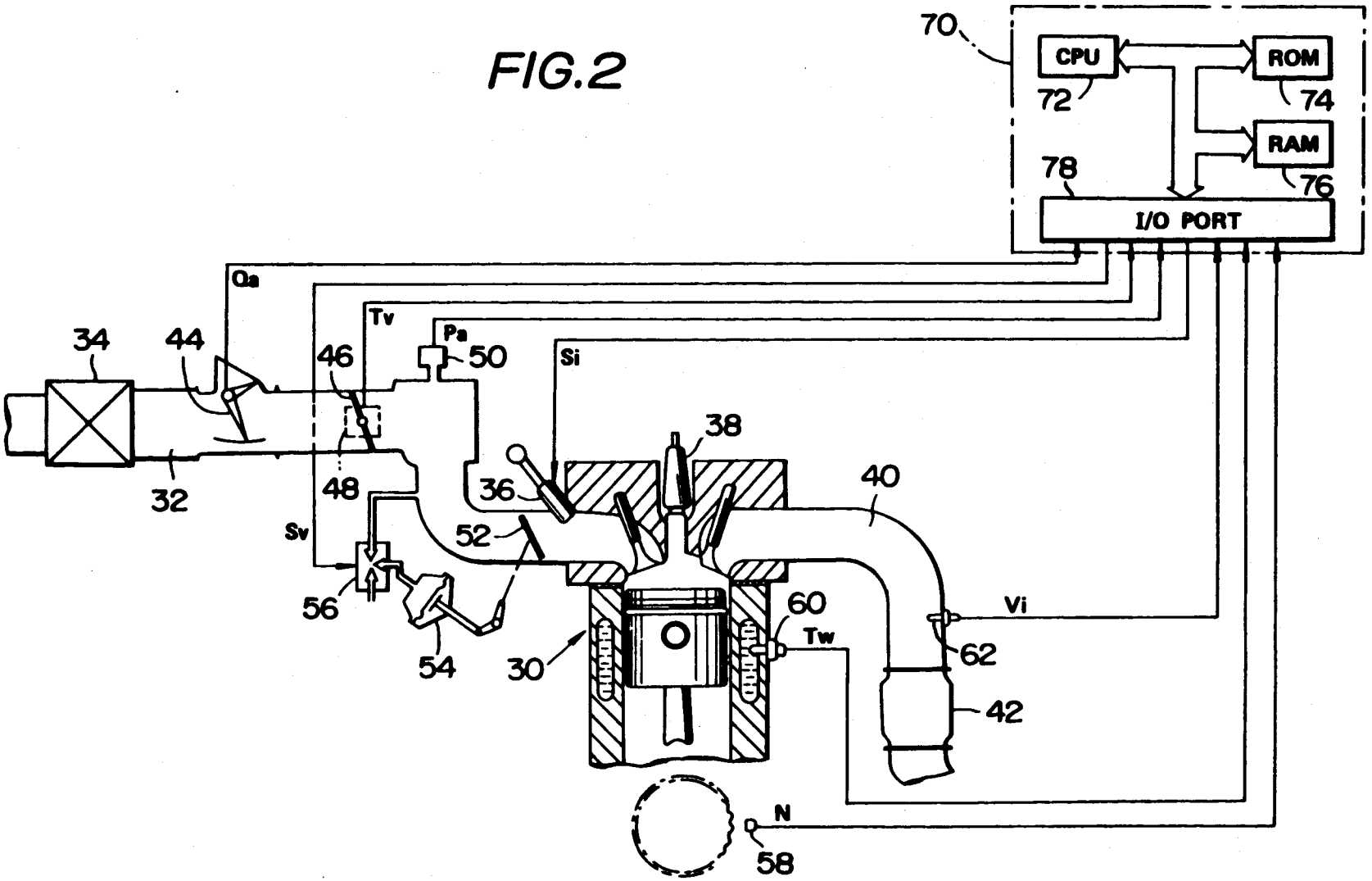
FIG. 2 is a diagrammatic illustration of an automotive engine provided with an air/fuel ratio control system as an embodiment of the invention.

As an embodiment of the invention, FIG. 2 shows an automotive internal combustion engine 30 provided with an air/fuel ratio control system which accomplishes its purpose by controlling the amount of fuel injection into the engine. In the usual manner an intake passage 32 extends from an air cleaner 34 to the cylinders of the engine 30, and an electromagnetically operated fuel injector 36 for each cylinder of the engine opens into the intake passage 32 at a section called an intake port. Numeral 38 indicates a spark plug provided to each cylinder. In an exhaust passage 40, a catalytic converter 42 occupies an intermediate section for purifying the exhaust gas by means of a conventional three-way catalyst, which exhibits its full activities when the engine is operated with an approximately stoichiometric air-fuel mixture.

In the intake passage 32 there is an airflow meter 44 of the flap type which produces a signal representative of the flow rate $Q_a$ of air admitted to the intake passage 32, and a sensor 48 is coupled with throttle valve 46 to produce a signal representative of the degree of opening $T_v$ of the throttle valve 46. A pressure sensor 50 is inserted into the intake passage 32 to detect the pressure of intake air at a section downstream of the throttle valve 46. A so-called swirl valve 52 is disposed in the intake passage 32 at a section close to the intake ports. By the action of an external drive 54 the swirl valve 52 is opened and closed so as to create a swirl of the air-fuel mixture, which transmits through the intake ports to the engine cylinders and contributes to improved combustion. A solenoid 56 is coupled with the drive 54 to control the magnitude of negative pressure applied to the drive 54. A crank-angle sensor 58 is provided to produce a signal representative of the engine revolving speed N. A temperature sensor 60 is disposed in the cooling water jacket to produce a signal representative of the cooling water temperature $T_w$. In this embodiment the airflow meter 44 and the crank-angle sensor 58 constitute the load detection means 14 in FIG. 1.

An oxygen sensor 62 is inserted into the exhaust passage 40 at a section upstream of the catalytic converter 42 to estimate an actual air/fuel ratio in the engine cylinders from the concentration of oxygen in the exhaust gas. The oxygen sensor 62 can be selected from various conventional and recently developed oxygen sensors most of which utilize an oxygen ion conductive solid electrolyte. However, the oxygen sensor 62 is required to be effectively operative not only when the air/fuel ratio in the engine is nearly stoichiometric but also when the air/fuel ratio is considerably higher or lower than the stoichiometric ratio. It is preferable that the output voltage (or current) $V_i$ of the oxygen sensor 62 has a definitive correlation with the actual air/fuel ratio in the engine over a wide range containing both sub-stoichiometric and super-stoichiometric regions.

The air/fuel ratio control system of FIG. 2 has a control unit 70 in which the control means 12, target value setting means 18, a major part of the transient condition detection means 16 and a part of the air/fuel ratio detection means 10 shown in FIG. 1 are integrated. This control unit 70 is a microcomputer comprised of CPU 72, ROM 74, RAM 76 and I/O port 78. The ROM 74 stores programs of operations of CPU 72. The RAM 76 stores various data to be used in operations of CPU 72, some of which are in the form of map or table. The signals produced by the above described sensors 44, 48, 50, 58, 60 and 62 are input to the I/O port 78. Based on the engine operating condition information gained from these input signals the control unit 70 provides a fuel injection signal $S_i$ to the injectors 36 so as to adjust the air/fuel ratio to the target value. In this embodiment the target value of air/fuel ratio is, normally, considerably higher than the stoichiometric ratio. Besides, the control unit 70 provides a swirl control signal $S_v$ to the solenoid valve 56.

Figure 3:
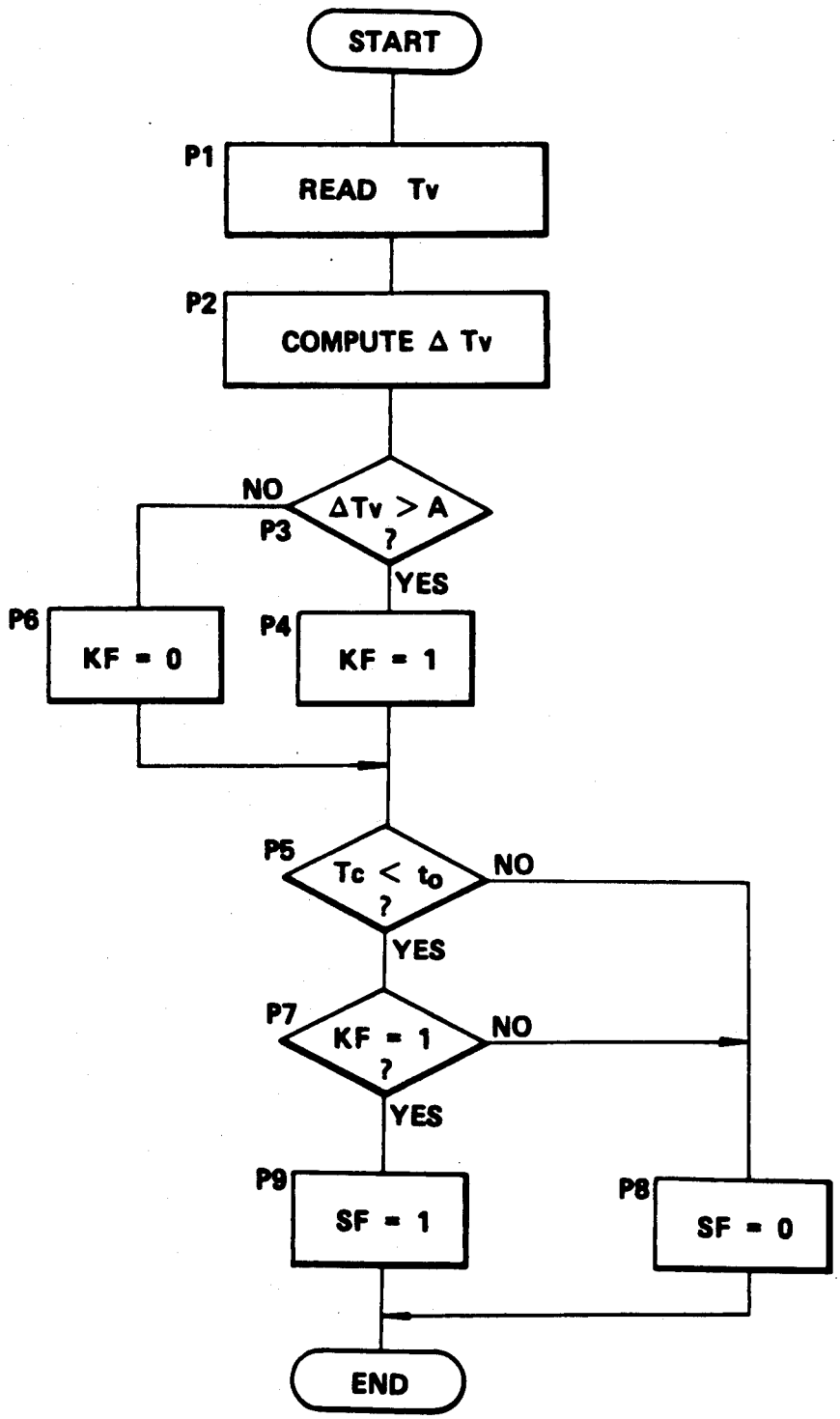
FIG. 3 is a flowchart showing a computer program stored in a microcomputer included in the air/fuel ratio control system of FIG. 2.

FIG. 3 is a flowchart for one of the computer programs stored in the ROM 74. This program is repeatedly executed at predetermined time intervals, such as 5 ms intervals, to make a judgment whether or not the engine is operating under a predetermined transitional condition where the target value of the air/fuel ratio should be decreased to the second value optimum for the activites of the three-way catalyst.

At the initial step P1 the throttle valve opening degree $T_v$ is read. The next step P2 is computation of a difference $\Delta T_v$ in the throttle valve opening degree $T_v$ within a predetermined unit time. Alternatively, $\Delta T_v$ may be given as a difference in $T_v$ between the instant value and the value at the immediately preceding execution of this program. At step P3 the difference $\Delta T_v$ is compared with a predetermined acceleration discriminant value A, which is greater than 0 (zero). If $\Delta T_v$ is greater than A, an "acceleration" flag KF is set (KF=1) at step P4, assuming that the engine 30 is under acceleration, and the program proceeds to step P5. If $\Delta T_v$ is not greater than A the acceleration flag KF is cleared (KF=0) at step P6, and the program proceeds to step P5. These operations are convenient and suitable for very accurate discrimination of predetermined accelerating conditions from different conditions. However, it is also possible to find the accelerating conditions by a different series of operations such as, for example, by differentiating $T_v$ and comparing $dT_v/dt$ with a predetermined discriminant value.

At step P5 it is determined whether or not the throttle valve 46 has moved away from its fully closed position for more than a predetermined length of time $t_0$. This is because when the throttle valve is moved from its fully closed position the magnitude of the required acceleration is, for a certain period of time, greater than in the cases of acceleration from steady-state operation of the engine, so that the air/fuel ratio should be decreased. If the actual length of time $T_c$ elapsed after movement of the throttle valve from its fully closed position is shorter than $t_0$ the program proceeds to step P7, where it is checked whether the acceleration flag KF has been set (KF=1) or not. If $T_c$ is not shorter than $t_0$ the program proceeds to step P8, where a "transitional" flag SF is cleared (SF=0). If the flag KF has been set the program proceeds to step P9, assuming that the engine is operating under such an accelerating condition that the air/fuel ratio should be decreased to the aforementioned second value. Then the execution of the routine ends by setting the transitional flag SF (SF=1) at step P9. If the acceleration flag KF is clear at step P7 the program proceeds to step P8, and the execution of the routine ends without setting the transitional flag SF.

Figure 4:
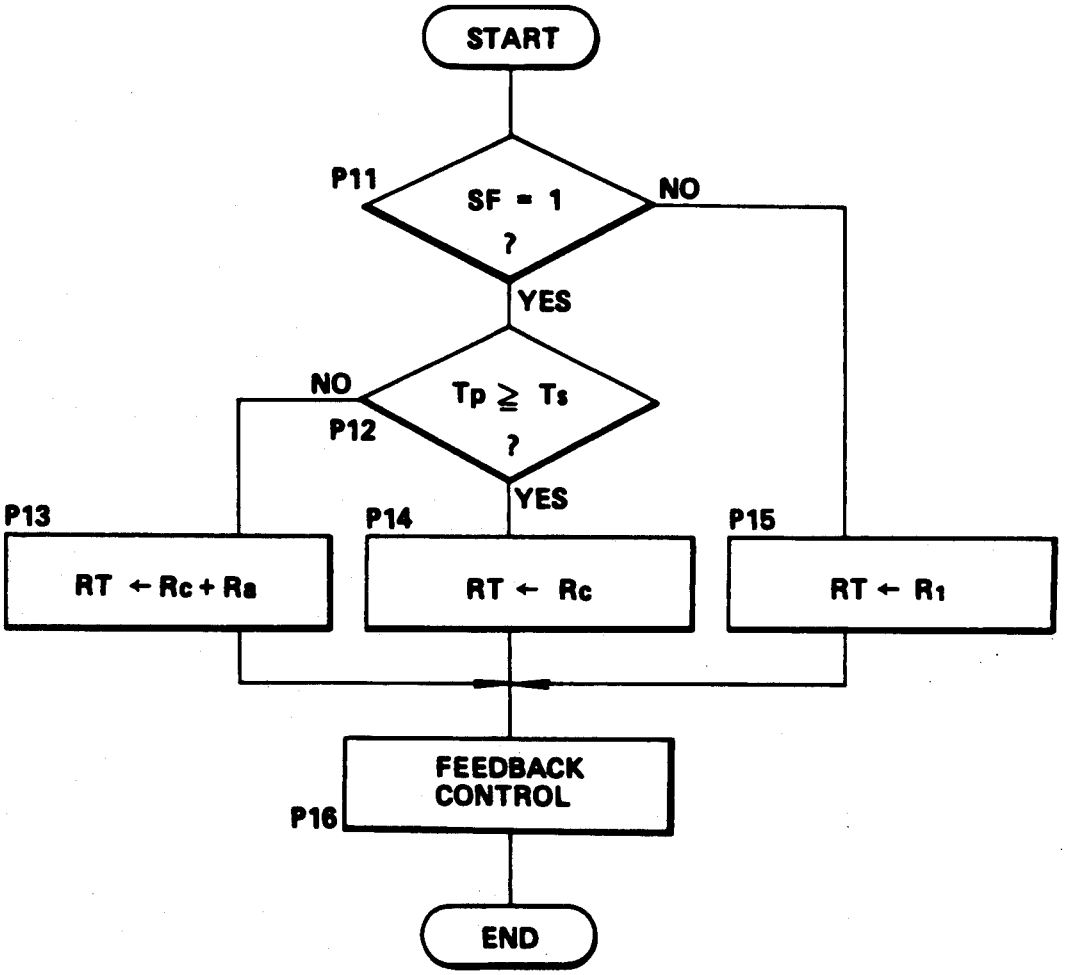
FIG. 4 is a flowchart showing another computer program stored in the same microcomputer.

FIG. 4 shows a main program for feedback control of the air/fuel ratio stored in the ROM 74. This program is repeatedly executed in synchronism with the revolutions of the engine 30.

The initial step P11 is checking whether the transitional flag SF has been set or not. If the flag has been set (SF=1) the program proceeds to step P12, where the length of time $T_p$ passed after setting the transitional flag SF is compared with a predetermined length of time $T_s$. The value of $T_s$ is determined according to the operating conditions of the engine. If $T_p$ is shorter than $T_s$ the program proceeds to step P13, where the target value (represented by RT) of the air/fuel ratio is set at the third value which is, as mentioned hereinbefore, lower than the second target value optimum for the activities of the three-way catalyst. In this embodiment the second target value (represented by $R_c$) of air/fuel ratio is the stoichiometric value ($\lambda=1$). The target value RT set at step P13 is given by the following equation.

$$RT=R_c+R_a \quad (1)$$

wherein $R_a$ is a predetermined negative value.

If the elapsed time $T_p$ is not shorter than $T_s$ the program proceeds from step P12 to step P14, where the target value RT of the air/fuel ratio is set at the second value $R_c$, i.e. stoichiometric value, without using the negative increment $R_a$.

If the transitional flag SF is clear (SF=0) at step P11 the program proceeds to step P15, where the target value RT of the air/fuel ratio is set at the first value, $R_1$. The first value $R_1$ of the air/fuel ratio is super-stoichiometric and may be a variable depending on the engine load. If so, the relationship between the engine load and the first target value $R_1$ is stored in the RAM 76 as a map or table, and the operations at step P15 include table look-up to find an optimum value based on the information supplied from the engine load detecting sensors 44 and 58 in FIG. 2.

After the target value setting operation at step P13, P14 or P15, the program proceeds to step P16 where an optimum amount of fuel injection, $T_i$, is computed according to the following equation (2) to perform feedback control of the air/fuel ratio with the target value determined in the above described manner. In the fuel injection signal $S_i$ which the control unit 70 supplies to each injector 36 the amount of fuel injection $T_i$ is indicated by the pulse width.

$$T_i=Q_A\times R_T\times C_f\times M_f+T_a \quad (2)$$

wherein $Q_A$ is the flow rate of intake air for each cylinder of the engine, $C_f$ is a correction factor for compensation of evaporation of a portion of the fuel and liquefaction of another portion of the fuel on the wall surfaces in the intake port, $M_f$ is a feedback correction factor for cancellation of any deviation of the detected air/fuel ratio from the target value, and $T_a$ is a supplement for compensation of a deviation of the actual duration of fuel injection from the pulse width in the fuel injection signal.

During steady-state operation of the engine the air flow rate $Q_A$ is computed from the output of the airflow meter 44 with a correction according to the temperature of intake air. Under a transient operating condition of the engine, further corrections are made based on the degree of throttle valve opening $T_v$ and the pressure of air $P_a$ measured with the sensor 50. It is necessary to make such minute corrections to thereby obtain very accurate information on the air flow rate $Q_A$ for accomplishment of very precise control of the air/fuel ratio or the amount of fuel injection in the embodiment shown in FIG. 2. The computation of $Q_A$ will be described in detail at the last part of this specification. The value of the correction factor $C_f$ is determined with reference to some parameters of the engine operating conditions such as the magnitude of acceleration or deceleration, temperature of the cooling water, time elapsed after starting the engine, etc.

Figure 5:
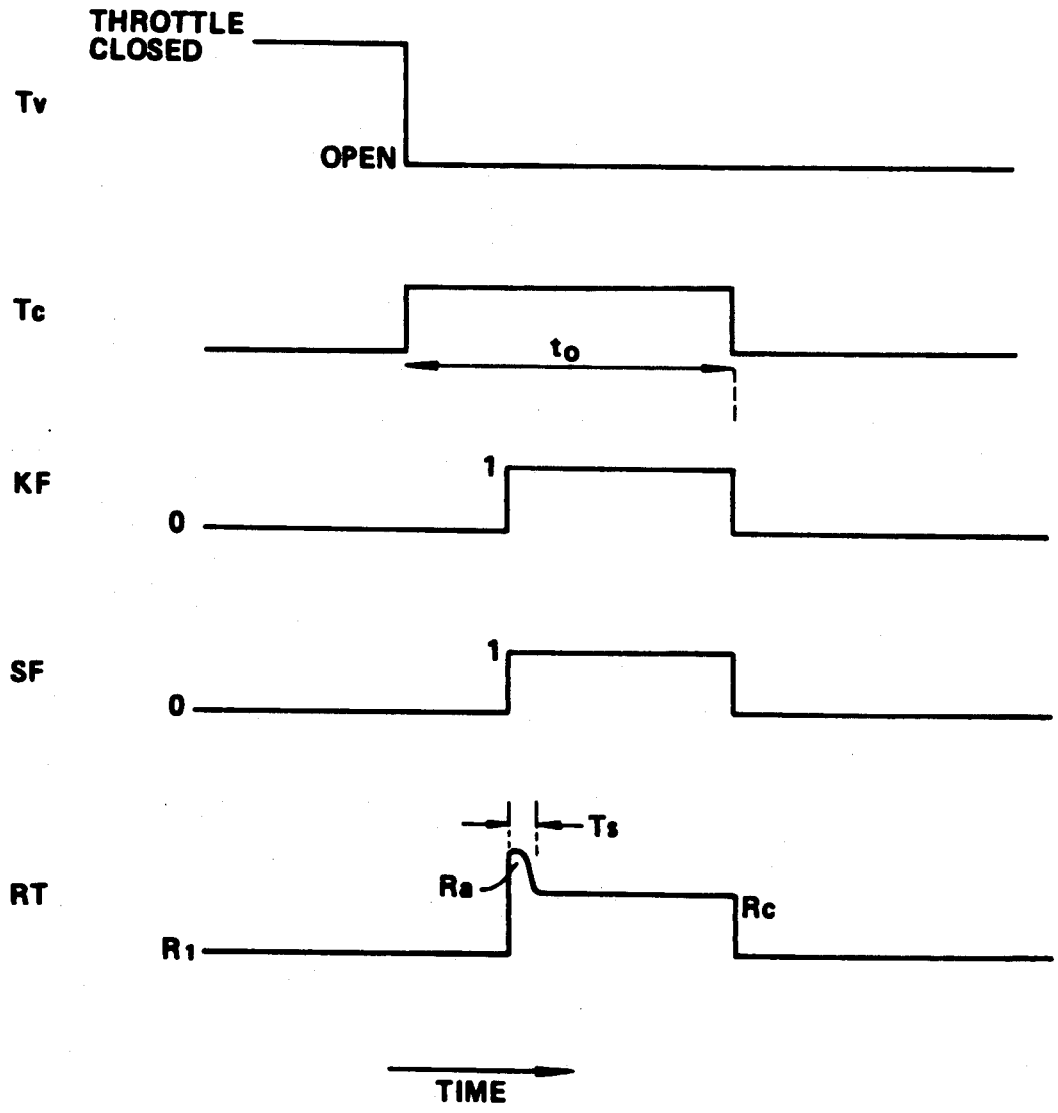
FIG. 5 is a chart showing the manner of the function of the aforementioned microcomputer in temporarily decreasing the air/fuel ratio under a transient operating condition of the engine.

FIG. 5 illustrates the above described operations of the control unit 70 to vary the target value RT of the air/fuel ratio when the engine is operating under a predetermined accelerating condition. If the acceleration flag KF is set and if the length of time $T_c$ elapsed after movement of the throttle valve from its fully closed position is shorter than the predetermined length of time $t_0$, it is decided that the target value RT of the air/fuel ratio should be decreased to the stoichiometric value $R_c$ optimum for the activities of the three-way catalyst. Then the transitional flag SF is set, and the target value RT is decreased. Initially the target value RT of the air/fuel ratio is set at a value smaller than the stoichiometric value $R_c$ by the absolute value of $R_a$, and after the lapse of the predetermined time $T_s$ the target value RT is set at the stoichiometric value $R_c$. The initial decrease of the air/fuel ratio from the stoichiometric value $R_c$, i.e. excessive enrichment of fuel, has the effect of quickly and considerably decreasing the concentration of oxygen in the exhaust gas flowing into the catalytic converter 42 and thereby promoting the consumption of excess oxygen in the catalytic converter 42. As a result, the conversion of NOx is efficiently accomplished even at the initial stage of the transition from steady-state operation of the engine to an accelerating condition. When the duration $T_c$ of the throttle-open condition reaches $t_0$ the acceleration flag KF is cleared, and therefore the transitional flag SF too is cleared. Then the target value RT of the air/fuel ratio is returned to the superstoichiometric first value $R_1$.

In the above described embodiment of the invention an accelerating condition is taken as an example of transient conditions where the air/fuel ratio should be adjusted to a value optimum for the activities of the three-way catalyst, such as the stoichiometric value. However, this is not limitative. Such shift of the air/fuel ratio target value is performed also under predetermined decelerating conditions. Furthermore, the target value of the air/fuel ratio is not necessarily shifted from a super-stoichiometric value to the stoichiometric value. In a special case such as transition from a steeply accelerating condition to a decelerating condition the target value may be shifted from a sub-stoichiometric value to the stoichiometric value. In such a case the target value is temporarily set at a value larger than the stoichiometric value for a predetermined period of time ($T_s$ in the foregoing description). This has the effect of promoting consumption of combustible gases accumulated in the catalytic converter during the acceleration operation and consequently reducing the emission of NOx.

In the above described embodiment the target value of the air/fuel ratio is shifted to adjust the actual air/fuel ratio to a value optimum for the activities of the three-way catalyst by feedback control. However, this is not limitative either. For example, an alternative measure is temporarily shifting the feedback control to open-loop control. If desired, the actual air/fuel ratio may be controlled by controlling the amount of air intake into the engine cylinders instead of controlling the feed of fuel.

Figure 6:
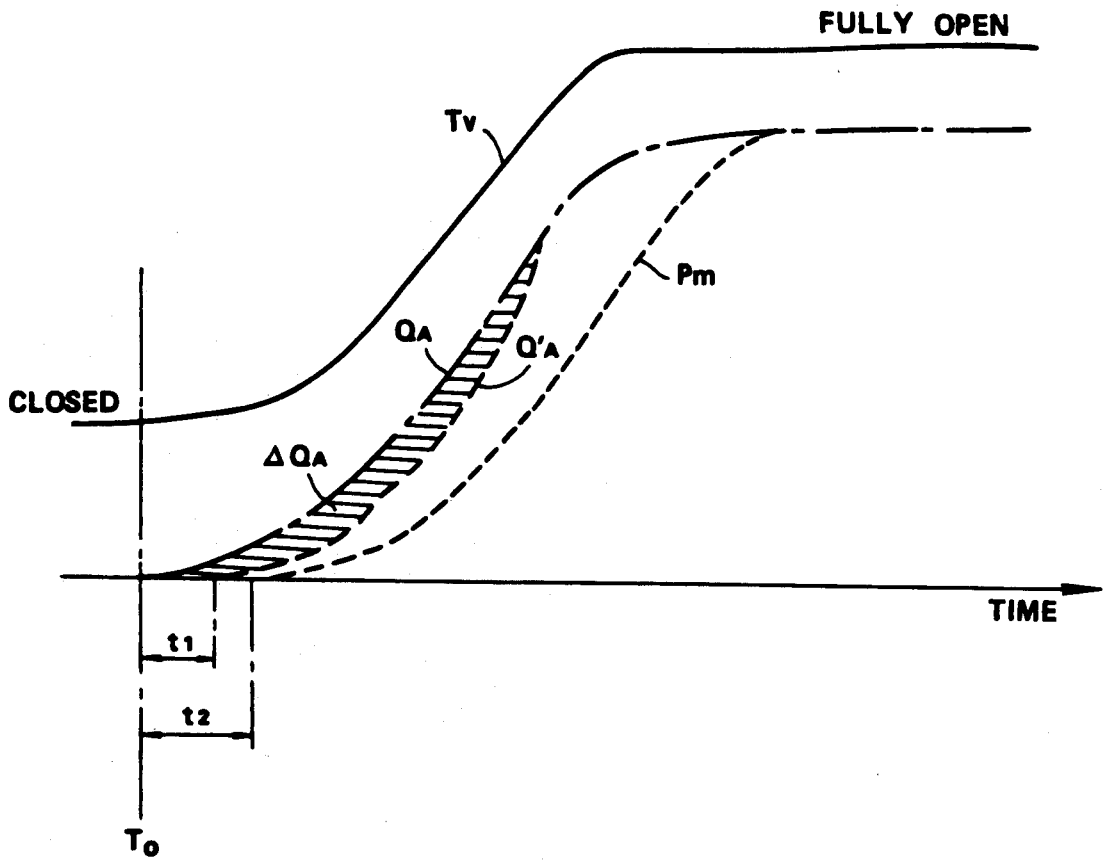
FIG. 6 is a chart showing the manner of computing the flow rate of air taken into each cylinder of the engine in the air/fuel ratio control system of FIG. 2.

Referring to FIG. 6, the following is a description of a preferred process of computing the air flow rate $Q_A$, during accelerating operation of the engine, to compute the amount of fuel injection $T_i$ according to the equation (2).

At the time-point $T_0$ the throttle valve begins to move away from its fully closed position so that the degree of throttle valve opening $T_v$ begins to vary. Accordingly the pressure of intake air $P_a$ measured by the sensor 50 begins to vary. In FIG. 6 the pressure $P_a$ is represented by $P_m$ which is an electrical signal obtained by treating the output of the sensor 50. The air pressure signal $P_m$ begins to vary with a time delay $t_2$ due to a pulsation suppressing effect. The curve $Q_A'$ represents an air flow rate for each cylinder of the engine computed from the output of the airflow meter 44 with correction according to the value of $P_m$. The value of $Q_A'$ begins to change with a time delay $t_1$ ($t_1 < t_2$) from the time-point $T_0$. The curve $Q_A$ represents the actual flow rate of air into each cylinder. There is a difference $\Delta Q_A$ indicated by the hatched area between the actual flow rate $Q_A$ and the calculated flow rate $Q_A'$. This means inaccuracy of the detection of the air flow rate under a transient operating condition of the engine. Such inaccuracy is corrected by the following operations.

First, $Q_A'$ is computed according to the following equation (3).

$$Q_A' = P_m + \alpha \Delta P_a \tag{3}$$

wherein $\alpha$ is a function of the engine revolving speed N, and $\Delta P_a$ is a difference in the intake air pressure $P_a$ in a predetermined unit time.

In computing $Q_A'$ as an estimation of $Q_A$ the equation (3) is used with consideration of the fact that inflow of air into each cylinder of the engine lasts even after completion of intake of fuel.

To cancel the difference $\Delta Q_A$ indicated by the hatched area in FIG. 6, the magnitude of $\Delta Q_A$ is estimated by calculation according to the following equation (4) with particular attention to the degree of throttle valve opening $T_v$ which begins to vary first.

$$\Delta Q_A = (\Delta T_v / N) \times Q_{AI} \tag{4}$$

wherein $Q_{AI}$ is the air flow rate ($Q_A$) at the initial stage of the transition from steady-state to acceleration and can be determined, for example, from the change in the degree of throttle valve opening $T_v$.

The calculated $\Delta Q_A$ is added to the air flow rate $Q_A'$ calculated from the outputs of the aforementioned sensors by using the equation (3) since the actual air flow rate $Q_A$ is assumed to be $Q_A' + \Delta Q_A$. In FIG. 6 the curve $Q_A$ represents the result of this calculation process, and this curve can be regarded as accurately representative of the actual air flow rate since there is good correlation between the degree of throttle opening $T_v$ and the air flow rate $Q_A$ represented by this curve. Thus, estimation of the air flow rate $Q_A$, i.e. amount of air taken into each cylinder of the engine, is accomplished with very improved accuracy. Of course, such improved accuracy can be attained in the case of deceleration too. As the air flow rate $Q_A$ is accurately estimated the amount of fuel injection $T_i$ can be determined very accurately by the equation (2), and therefore feedback control of the air/fuel ratio can accurately be accomplished.

After a while the air flow rate $Q_A'$ given by the equation (3) will accord with $P_m$. After that the actual air flow rate $Q_A$ with respect to each cylinder can be calculated simply from either the output of the airflow meter 44 located upstream of the throttle valve or the output of the pressure sensor 50 located downstream of the throttle valve without need of computing $\Delta Q_A$.

What is claimed is:

1. A control system for feedback control of the air/fuel ratio of an air-fuel mixture supplied to an internal combustion engine which uses a three-way catalyst for purifying the exhaust gas, the control system comprising:

air/fuel ratio detection means for detecting actual values of air/fuel ratio in the engine;

load detection means for detecting the load under which the engine is operating;

transient condition detection means for detecting any of predetermined transient operating conditions of the engine; and control means for performing feedback control of the feed of fuel or air to the engine based on the detected actual values of air/fuel ratio, the control means comprising target value setting means for determining the target value of the air/fuel ratio according to information obtained by said load detection means and said transient condition detection means such that the target value becomes a first value which is higher than the stoichiometric air/fuel ratio at least during predetermined steady-state operation of the engine and shifts to a second value which is optimum for the activities of the three-way catalyst when any of said predetermined transient operating conditions is detected and modulation means for regulating the feed of fuel or air to the engine at the start of the shift of the target value such that the air/fuel ratio deviates from said second value in the direction reverse to the target value immediately before the shift only for a predetermined period of time.

2. A control system according to claim 1, wherein said air/fuel ratio detection means comprises means for sensing the concentration of oxygen in the exhaust gas.

3. A control system according to claim 1, wherein said load detection means comprises means for detecting the amount of air taken into the engine and means for detecting the revolving speed of the engine.

4. A control system according to claim 1, wherein said transient condition detection means comprises means for detecting the degree of opening of throttle valve provided to the engine and means for finding the magnitude of a difference in the degree of opening of the throttle valve per predetermined unit time.

5. A control system according to claim 1, wherein said second value is a stoichiometric value.

6. A control system according to claim 1, wherein at least said control means, a part of said load detection means and a part of said transient condition detection means are integrated in a microcomputer.

7. A control system for feedback control of an air/fuel ratio of an air-fuel mixture supplied to an internal combustion engine which used a three-way catalyst for purifying the exhaust gas, the control system comprising:

air/fuel ratio detection means for detecting actual values of air/fuel ratio in the engine;

load detection means for detecting a load under which the engine is operating;

transient condition detection means for detecting any of a plurality of predetermined transient operating conditions of the engine; and control means for performing feedback control of the feed of fuel or air to the engine based on the detected actual values of air/fuel ratio, the control means comprising target value setting means for determining a target value of the air/fuel ratio according to information obtained by said load detection means and said transient condition detection means said target value setting means being operable for setting the target value to a first value higher than the stoichiometric air/fuel ratio at least during predetermined steady-state operation of the engine and for shifting the target value to a second value selected to be optimum for the activity of the three-way catalyst when any of said predetermined transient operating conditions is detected; and modulation means for regulating the feed of fuel or air to the engine when said target setting means starts to shift the target value to said second value, said modulation means being operable for a predetermined time period at the start of the shifting of the target value for regulating said feed, and to deviate the target air/fuel ratio from said second target value in a direction opposite to the deviation of the first target value therefrom prior to shifting of the target value by said target value setting means.

8. A control system as recited in claim 7, wherein:

said modulation means comprises means operable during acceleration for regulating said feed to deviate from said second target value for said predetermined time period as if the target value were lower than said second value by a predetermined amount.

9. A control system as recited in claim 7, wherein:

said modulation means comprises means operable during deceleration for regulating said feed to deviate from said second target value for said predetermined time period as if the target value were higher than said second target value by a predetermined amount.

* * * * *